US006223966B1

(12) United States Patent
Nayrac et al.

(10) Patent No.: US 6,223,966 B1
(45) **Date of Patent: *May 1, 2001**

(54) FIXING DEVICE USING COMPRESSED GAS

(75) Inventors: Frédéric Nayrac, Valence; Guy Jaillet, La Roche de Glun; Bruno Toulouse, Valence, all of (FR)

(73) Assignee: Societe de Prospection et d'Inventions Techniques Spit, Bourg-les-Valence (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/244,990

(22) Filed: Feb. 4, 1999

(30) Foreign Application Priority Data

Feb. 13, 1998 (FR) ..... 98 01748

(51) Int. Cl.[7] ..... B25C 1/04

(52) U.S. Cl. ..... 227/130; 60/632; 123/465 C; 227/10

(58) Field of Search ..... 227/130, 10, 8, 227/9; 123/465 C; 60/632, 633; 173/209

(56) References Cited

U.S. PATENT DOCUMENTS

| | | | | |
|---|---|---|---|---|
| Re. 32,452 | | 7/1987 | Nikolich | 123/46 SC |
| 3,967,771 | | 7/1976 | Smith | 227/10 |
| 4,200,213 | | 4/1980 | Liesse | 227/10 |
| 4,522,162 | * | 6/1985 | Nikolich | 123/46 SC |
| 4,712,379 | * | 12/1987 | Adams et al. | 60/632 |
| 4,717,060 | | 1/1988 | Cotta | 227/10 |
| 4,721,240 | | 1/1988 | Cotta | 227/10 |
| 4,739,915 | * | 4/1988 | Cotta | 227/10 |
| 4,759,318 | * | 7/1988 | Adams | 123/46 SC |
| 4,905,634 | | 3/1990 | Veldman | 227/10 |
| 4,913,331 | * | 4/1990 | Utsumi et al. | 227/10 |
| 5,191,861 | | 3/1993 | Kellerman et al. | 123/46 SC |
| 5,484,094 | * | 1/1996 | Gupta | 227/8 |
| 5,680,980 | * | 10/1997 | Robinson | 227/130 |
| 5,752,643 | * | 5/1998 | MacVicar et al. | 227/130 |

FOREIGN PATENT DOCUMENTS

| | | |
|---|---|---|
| 0 252 653 | 1/1988 | (EP) . |
| 0 527 559 | 2/1993 | (EP) . |

* cited by examiner

*Primary Examiner*—Peter Vo
*Assistant Examiner*—Jim Calve
(74) *Attorney, Agent, or Firm*—Lowe Hauptman Gilman &Berner, LLP

(57) ABSTRACT

Fixing device using compressed gas, comprising a casing (1) containing a combustion chamber (17), a housing (4) for receiving a cartridge of compressed gas (5), a duct (19) for injecting compressed gas into the combustion chamber (17) from the cartridge (5), a magazine (3) for supplying fixing elements, a housing (6) for receiving a battery (7) for supplying electricity and a handle (8) connected directly to the casing (1) and substantially perpendicular to an axis (11) of the casing (1). The housing (4) for receiving the cartridge (5) extends substantially parallel to the handle (8) and is offset with respect thereto along the axis (11) of the casing (1).

6 Claims, 2 Drawing Sheets

FIXING DEVICE USING COMPRESSED GAS

TECHNICAL FIELD

The invention relates to a fixing device using compressed gas, comprising a casing containing a combustion chamber, a housing for receiving a cartridge of compressed gas, having a duct for injecting compressed gas into the combustion chamber, a plug guide projecting at the front of the casing, a magazine of plugs, a housing for receiving a battery and a firing handle on which is mounted a trigger for controlling explosion of the combustion gas contained in the combustion chamber by means of an ignition device.

BACKGROUND ART

The plug magazine and the firing handle extend substantially perpendicular to the axis of the casing and are offset with respect to each other along this axis, the magazine communicating with the plug guide, and the handle being connected to the casing. The battery housing generally extends substantially perpendicular to the axis of the casing, along the plug magazine.

In certain devices the cartridge housing extends parallel to the axis of the casing, between the casing and the handle, whereas in other devices the fuel cartridge is housed inside the firing handle.

These fixing devices are generally poorly balanced so that an operator, when holding the device by gripping the firing handle with one hand, experiences difficulties in handling the device and stabilising it in the firing position.

DISCLOSURE OF THE INVENTION

It is an object of the present invention for a device of the type defined above to be balanced by locating its center of gravity substantially at a point on the handle to which the operator applies his index finger.

Another object is to bring the center of gravity of the fixing device closer to this ideal balance point.

To this end the invention relates to fixing device using compressed gas comprising a casing containing a combustion chamber, a housing for receiving a compressed gas cartridge, means for injecting compressed gas into the combustion chamber from the cartridge, a magazine for supplying fixing elements, a housing for receiving means for supplying electricity and a handle directly connected to the casing and substantially perpendicular to an axis of the casing, characterised in that the cartridge housing extends substantially parallel to the handle and is offset with respect thereto along the axis of the casing.

This type of relative arrangement of the cartridge housing and the handle offers a better distribution of the weight of the various elements of the device.

The cartridge housing is preferably disposed between the handle and the magazine for supplying fixing elements.

In a preferred embodiment, a bridge for housing the means for supplying electricity is provided, connecting the cartridge housing and the handle.

The housing for receiving the means for supplying electricity no longer being connected to the magazine of fixing elements, the device is still supplied electrically when the magazine is removed.

The applicant has also managed to exploit the generally considerable weight of the means for supplying electricity in order to balance the device still further.

BRIEF DESCRIPTION OF THE DRAWING

The invention will be better understood with the aid of the following description of a particular embodiment of the fixing device of the invention with reference to the attached drawing in which.

BEST MODE FOR CARRYING OUT THE INVENTION

Figure 1:
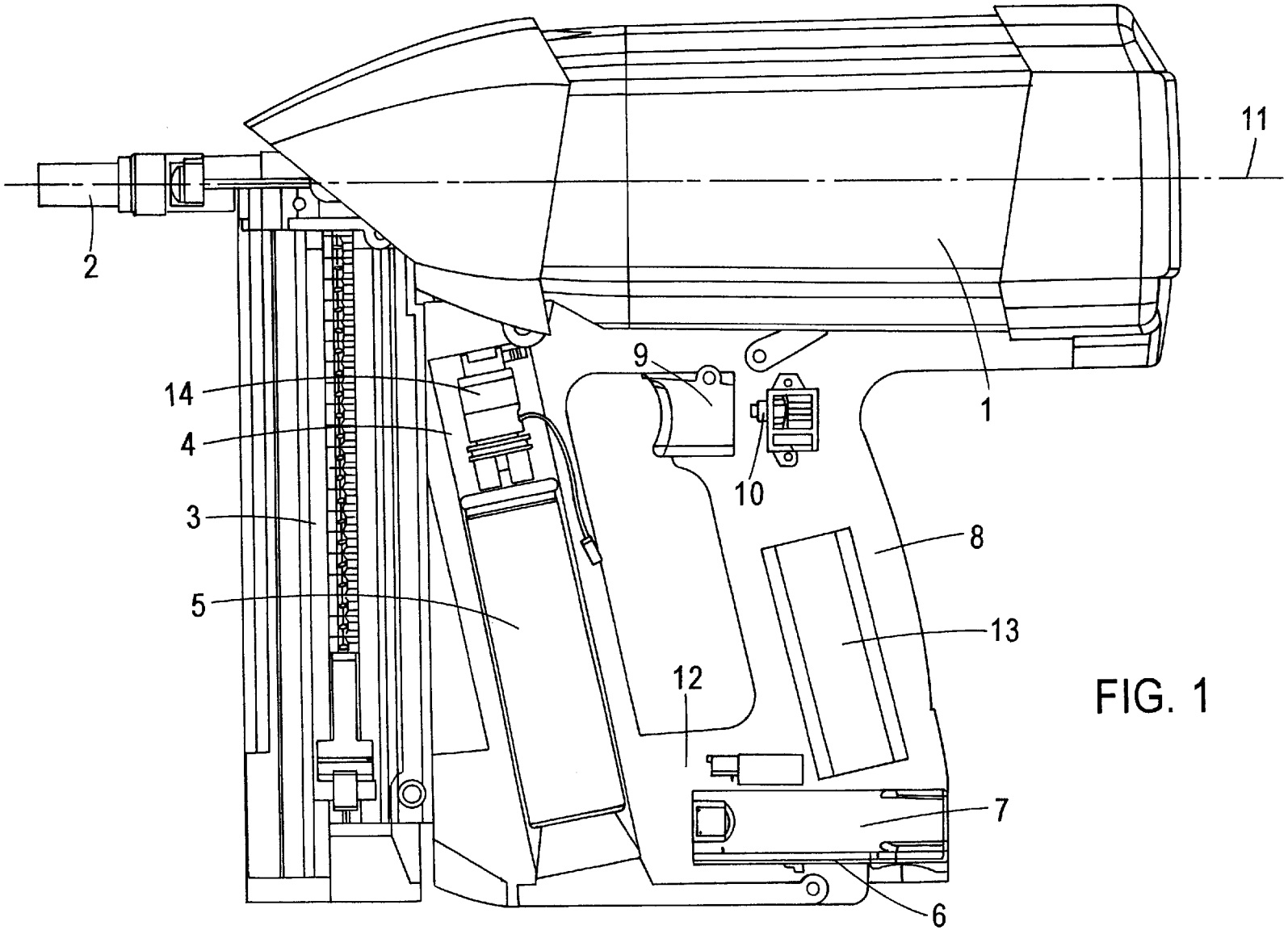
FIG. 1 illustrates a lateral view of the fixing device.

The fixing device of the invention is intended to fix fixing elements, in this case plugs, into a fixing support, a concrete wall, for example, by explosion of compressed gas.

The device essentially comprises a casing 1, a plug guide 2 projecting from the front of the casing, a magazine 3 for supplying plugs, a housing 4 for receiving a cartridge of compressed gas 5, a housing 6 for receiving a battery 7 for supplying electricity to the device, and a handle 8. The casing 1 and the plug guide 2 both have an axis 11.

Figure 2:
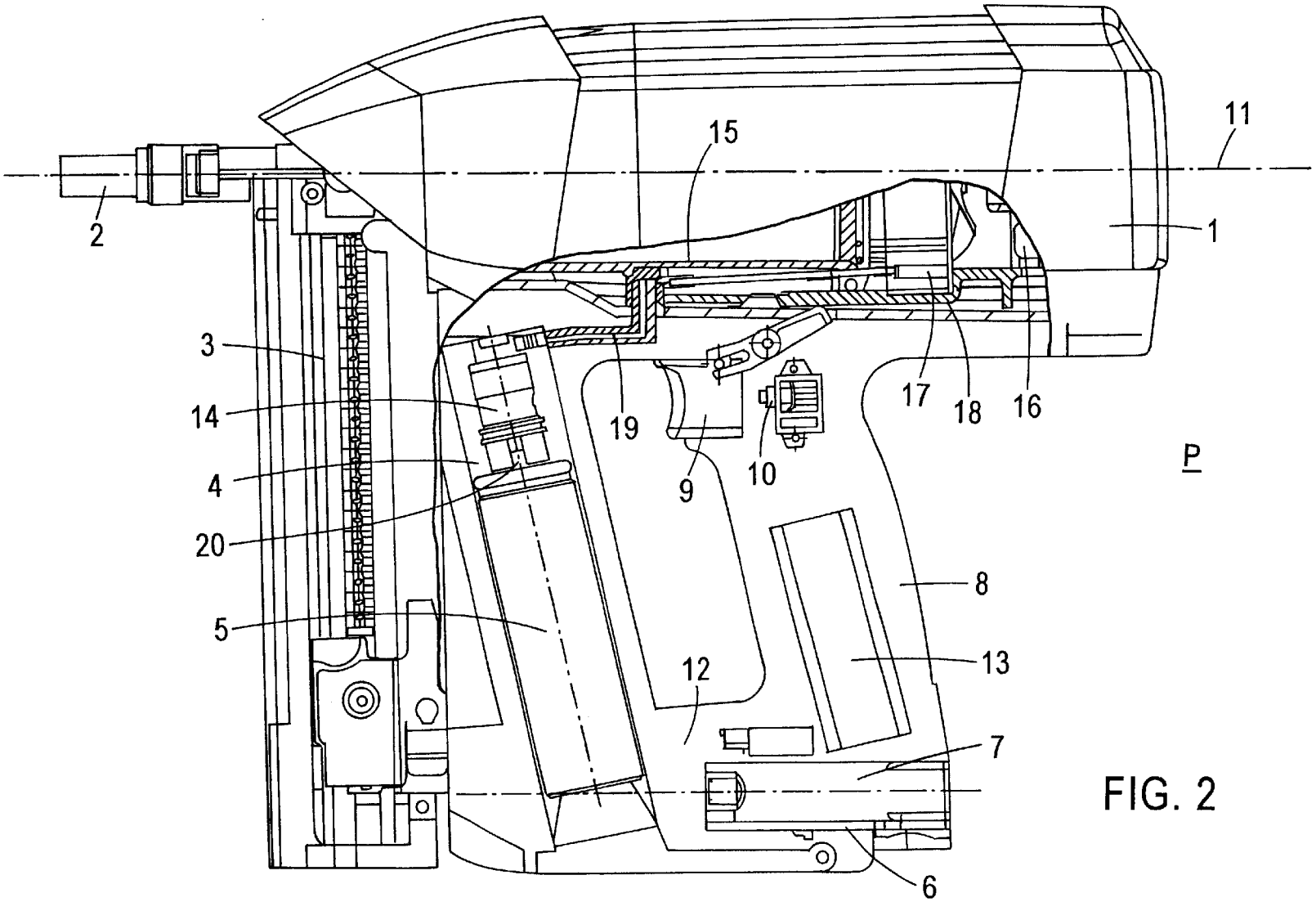
FIG. 2 illustrates a partial lateral cross-sectional view of the device of FIG. 1.

The casing 1 contains a cylinder 15 (see FIG. 2) in which is mounted a plug-propelling piston, a rear cylinder head 16, a combustion chamber 17 and a combustion chamber sleeve 18.

The housing 4 also contains a solenoid valve 14 for metering gas injected into the combustion chamber 17, intended to receive an injection joining piece for the compressed gas cartridge 5. The solenoid valve 14 extends along an axis 20 as an extension of which the compressed gas cartridge 5 is intended to extend after introduction into the housing 4. A duct 19 for injecting compressed gas into the combustion chamber 17 from the cartridge 5 connects the solenoid valve 14 to the combustion chamber 17 and in this case enters substantially in the middle of the combustion chamber 17 along the axis 11.

The handle 8 has a trigger 9 provided to actuate a switch 10 for controlling an ignition device intended to explode the compressed gas contained in the combustion chamber 17.

An electronic module 13 for controlling the electronics of the device, and in particular the solenoid valve 14 and the ignition device, is housed inside the handle 8.

The handle 8, the housing 4 for receiving the cartridge 5, and the magazine of plugs 3 extend in a common plane P containing the axis 11, on the same side of the axis 11 in this plane P, substantially perpendicular to the axis 11. The handle 8 and the housing 4 for the cartridge 5 are directly connected at one of their ends to the casing 1. The three elements 8, 4, 5 are thus substantially parallel to each other. It should be emphasized that the cartridge 5, introduced into its housing 4, extends substantially parallel to the handle 8.

The handle 8 is in this case connected substantially to the middle of the casing 1, along the axis 11, and the magazine 3 communicates with the plug guide 2, the magazine 3 thus being offset forwards with respect to the handle 8 along the axis 11. The housing 4 for receiving the cartridge 5 is also offset forwards with respect to the handle 8 and is disposed between the magazine 3 and the handle 8 along the axis 11.

A bridge 12 for housing the battery 7, and in which the housing 6 for receiving the battery 7 is arranged, connects the respective ends of the housing 4, for receiving the cartridge 5, and the handle 8 opposite to their ends which are connected to the casing 1. The bridge 12 and the battery 7, placed in its housing 6, extend substantially parallel to the axis 11.

By reason of the arrangement of the housing 4 for the cartridge 5, of the bridge 12 for housing the battery 7, of the handle 8 and of the plug magazine 3 of the centre of gravity of the device is substantially at an ideal point of balance which is that on which an operator places his index finger when holding the device in one hand by means of the handle in order to fire. This ideal point is substantially at the trigger 9.

What is claimed is:

1. Fixing device using compressed gas, comprising a casing (1) containing a combustion chamber (17), a housing (4) for receiving a cartridge of compressed gas (5), a gas injecting passageway connected to the compressed gas cartridge and the combustion chamber for injecting compressed gas into the combustion chamber (17) from the cartridge (5), a magazine (3) for supplying fixing elements, a source of electricity, a housing (6) for receiving said source of electricity, and a handle (8) connected directly to the casing (1), wherein said housing (4) for receiving the cartridge (5) is offset and physically separated with respect thereto along the casing (1) to the handle to form a space therebetween enabling a user's hand to extend into the space and wrap around and grasp the handle without grasping the cartridge housing ,and wherein said handle extends substantially perpendicular to a longitudinal axis of the casing and wherein said housing for receiving the cartridge extends substantially parallel to the handle.

2. Device according to claim 1, wherein the housing (4) for receiving the cartridge (5) is disposed between the handle (8) and the magazine (3) for supplying fixing elements.

3. Device according to claim 1, further comprising a bridge (12) containing said housing (6) to house the source of electricity and connect the cartridge housing (4) to the handle (8).

4. Device according to claim 3, wherein the bridge (12) connects the respective ends of the cartridge housing (4) and the handle (8), opposite to their ends which are connected to the casing (1).

5. Device according to claim 1, wherein the gas injecting passageway enters the casing substantially in the middle of the combustion chamber (17).

6. Device according to claim 1, further comprising a solenoid value (14) for metering compressed gas, and being located along an axis (20) in alignment with the compressed gas cartridge (5).

* * * * *